US006095658A

United States Patent [19]

Kalousis

[11] Patent Number: 6,095,658

[45] Date of Patent: Aug. 1, 2000

[54] MULTIPLE ROTARY SOCKET HAND TOOL

[76] Inventor: James Kalousis, 305 Broadwell Ave., Union, N.J. 07083

[21] Appl. No.: 09/255,599

[22] Filed: Feb. 22, 1999

[51] Int. Cl.[7] ..... B25B 17/00; B25B 23/18

[52] U.S. Cl. ..... 362/119; 362/120; 81/57.5; 81/57.29

[58] Field of Search ..... 362/109, 119, 362/208, 120; 81/57.11, 57.12, 57.13, 57.29, 57.36, 57.43, 57.5, 57

[56] References Cited

U.S. PATENT DOCUMENTS

D. 375,668 11/1996 Kalousis .

2,943,652 7/1960 Chilton ..... 81/435

4,215,601 8/1980 Mann .

4,345,445 8/1982 Warthen .

4,876,929 10/1989 Kozak .

4,936,169 6/1990 Parsons ..... 81/57.5

5,020,281 6/1991 Neff .

5,638,726 6/1997 Pelkonen et al. .

5,931,061 8/1999 Kuo ..... 81/57.29

*Primary Examiner*—Y. Quach

[57] ABSTRACT

A powered hand tool using a single, replaceable tool disk for access to multiple sockets, screwdriver blades, drilling bits, or other tool heads. By rotating the tool disk on a hand tool body, each of the multiple tool heads on the tool disk can be placed in use.

15 Claims, 6 Drawing Sheets

MULTIPLE ROTARY SOCKET HAND TOOL

BACKGROUND OF THE INVENTION

1. Technical Field

The invention relates to a hand tool and, more particularly, to a powered hand tool that allows access to multiple sizes and types of rotary driven sockets, or other tool bits, without having to remove one socket, or other tool bit, from the hand tool to place another socket, or tool bit, on the hand tool.

2. Background Art

When using individual sockets with a conventional powered socket drive, it is necessary to locate the desired socket size and attach it to the socket wrench. The individual sockets, relatively small in size, are easily misplaced and difficult to select from when looking for a particular size.

With the present invention, a plurality of sockets are included on a single rotary tool disk that is attached to a hand tool body. By rotating the tool disk and placing the desired sized socket in the operating position, different socket sizes can be selected without removing and installing individual sockets on the tool.

One advantage in use of the present invention, is in the instance where a tool user must initially guess the size of the socket to be used, and then possibly change to another socket size based upon an initial incorrect guess. For example, looking at a hex nut that is actually 3/16-inch, the user may initially guess at a selection of 1/8-inch. Having done so, he or she must now remove the 1/8-inch individual socket from the tool, locate the 3/16-inch individual socket, and then install it on the tool. Using the present tool, with a single tool disk including socket sizes 1/16-inch, 1/8-inch, 3/16-inch and 1/4-inch, with an initial incorrect guess of 1/8-inch, the user would simply rotate the tool disk to place the 3/16-inch tool disk in the operating position and use the hand tool. Therefore, the present invention provides an efficient method of selecting among various tool bits.

Another application of the present invention is in the assembly of devices that require repetitive use of a number of tools in a mixed fashion. For example, a particular application may require repetitive use of a 1/8-inch socket, a 16-mm socket, a 4-mm socket, and a #2 Phillips screwdriver bit. These four tools bits can be provided on a single tool disk so that the user can rapidly switch from one tool bit to another by rotating the tool disk and placing the desired tool bit in the operating position. Therefore, the present invention provides an efficient method of using multiple tool bits in repetitive operations.

SUMMARY OF THE INVENTION

In its broad aspects, the present invention is a hand tool with a plurality of selectable tool bits. A tool body provides power and control (tool drive) for a transmission system that transmits rotational torque to the tool bit by a flexible drive shaft with gearing for drive connection to the gearing of a selected tool bit. The tool disk includes a plurality of tool bits, such as sockets screwdriver bits, or other bits, or a mixture of different types of bits, each bit having associated gearing that permits connection to the drive gear adapted to the flexible drive shaft. The tool disk can rotate on an axis relative to the tool body so that each of the plurality of bits can be selected without placing individual tool bits on the powered hand tool. Power to the hand tool may be provided either by a battery in the tool body or by an external power source. A removable flashlight may be attached to the hand tool.

In another aspect, the present invention comprises a tool disk with a plurality of selectable tool bits for use with a hand tool. A retaining plate for each tool bit holds the drive ball bearing and drive gear associated with each tool bits to the inner body of the tool disk. Each socket, or other tool bit, is located radially around the perimeter of the tool disk, and is attached to its associated drive ball bearing and drive gear. Two end plates are provided on either side of the tool disk. On one end plate, an opening is provided for access to the drive gear associated with each tool bit so that an external flexible drive transmission can be attached to a selected tool bit. A rotating shaft is provided through the center of the tool disk so that it can be rotated when attached to a tool body.

In still another aspect of the invention, the present invention is a method for selecting among a plurality of tool bits on a tool disk that is connected to a tool body. Each tool bit has an associated drive gear. The tool body includes a flexible transmission drive with gearing that permits connection to the gearing associated with drive gear for each tool bit. The tool disk is rotated about its axis to place a desired tool bit in the operating position. When the desired tool bit is selected by placing the desired tool bit in the operating position, the tool disk is locked to prevent further rotation of the disk. The gearing for the flexible transmission drive is then connected to the gearing for the selected tool bit. The connection between the gearing of the flexible transmission drive and the gearing of the selected tool bit can be made and disconnected quickly to provide for easy selection among the multiple tool bits on the tool disk.

Additional objects, advantages and other useful features of the invention will become apparent to those skilled in this art from the following description, wherein I have shown and described a preferred embodiment of this invention, simply by way of illustration of one of the modes best suited to carrying out the invention. As will be realized, the invention is capable of other and different embodiments, and its several details are capable of modifications in various, obvious aspects, all without departing from the invention. Accordingly, the description is to be regarded as illustrative in nature, and not restrictive. The objects and advantages of the invention may be realized and attained by means of the instrumentalities and combinations particularly pointed out and claimed in the appended claims.

DETAILED DESCRIPTION OF THE INVENTION

Figure 1:
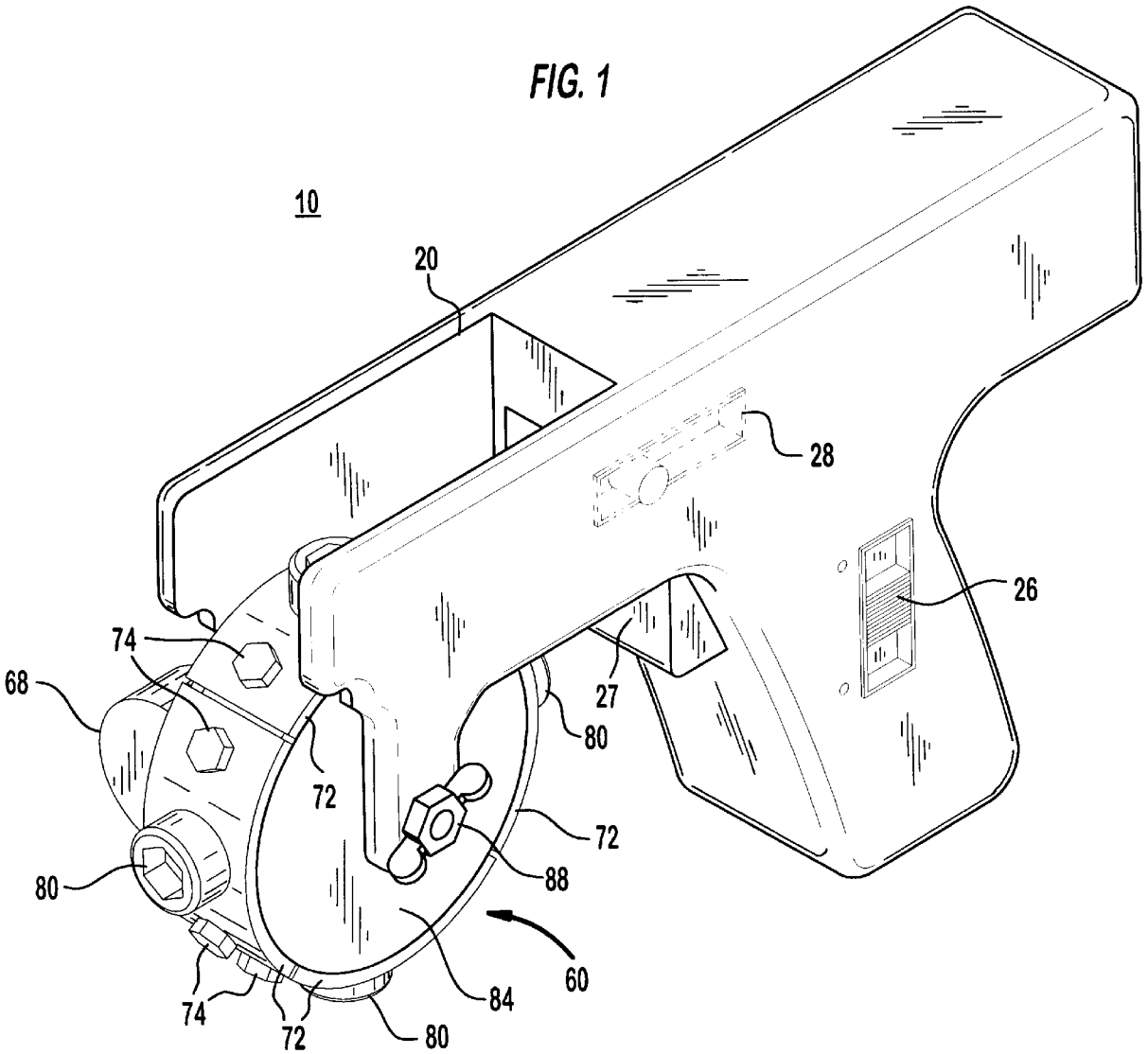
FIG. 1 is a perspective view from the left side of one embodiment of the multiple rotary socket hand tool of the present invention.
Figure 2:
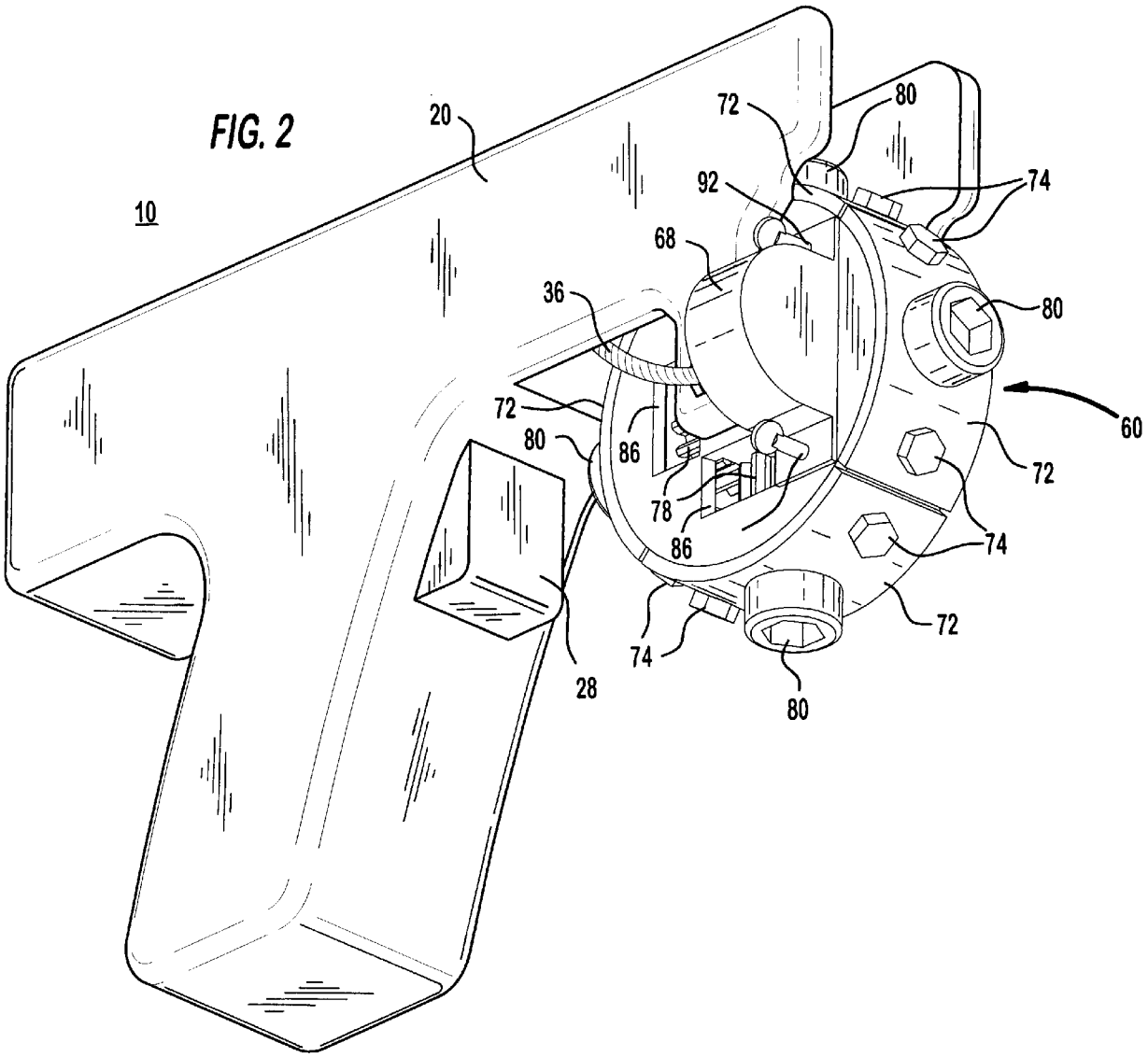
FIG. 2 is a perspective view from the right side of one embodiment of the multiple rotary socket hand tool of the present invention.
Figure 3:
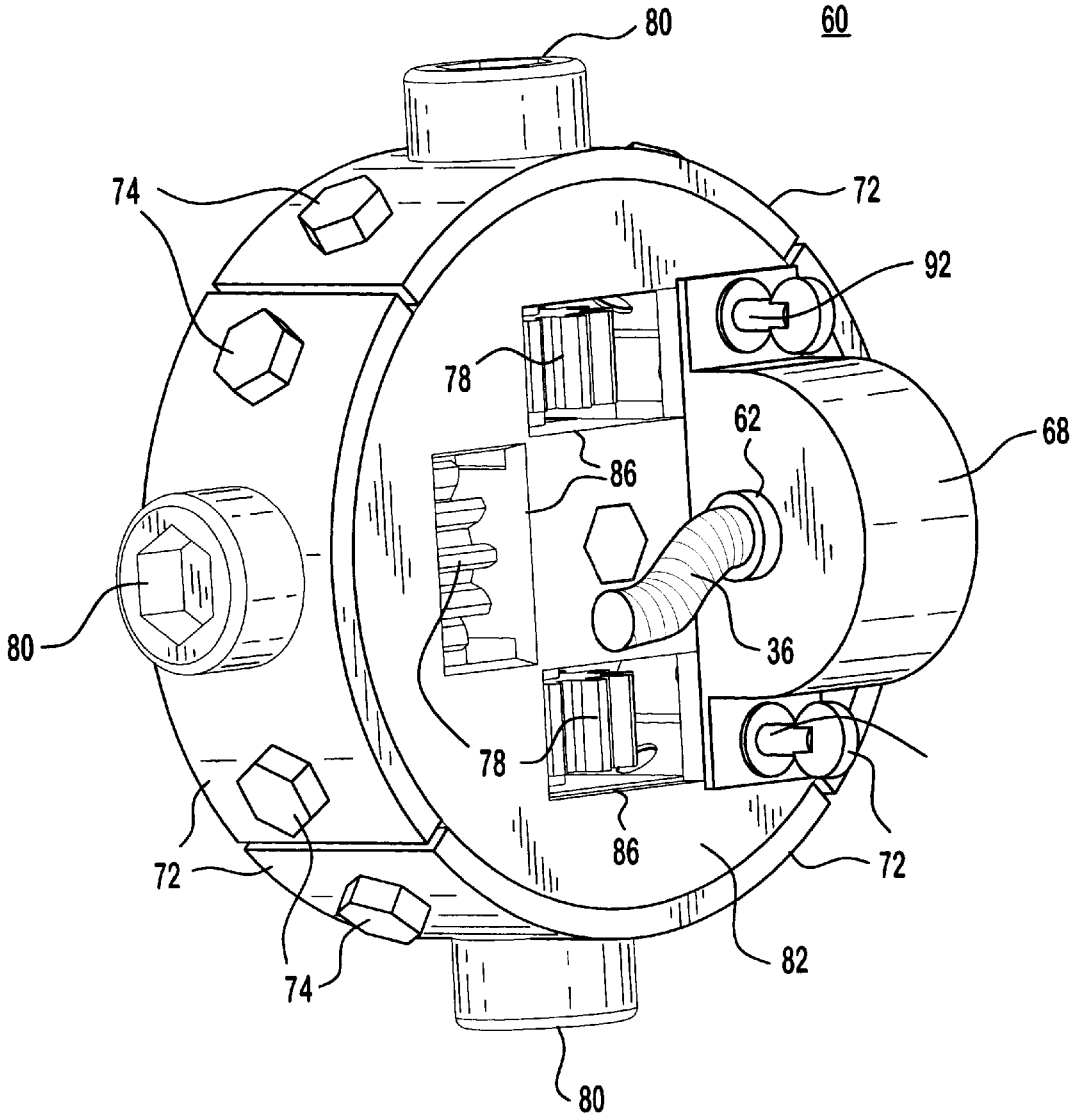
FIG. 3 is a perspective view of one embodiment of the tool disk used with the multiple rotary socket hand tool of the present invention.
Figure 5:
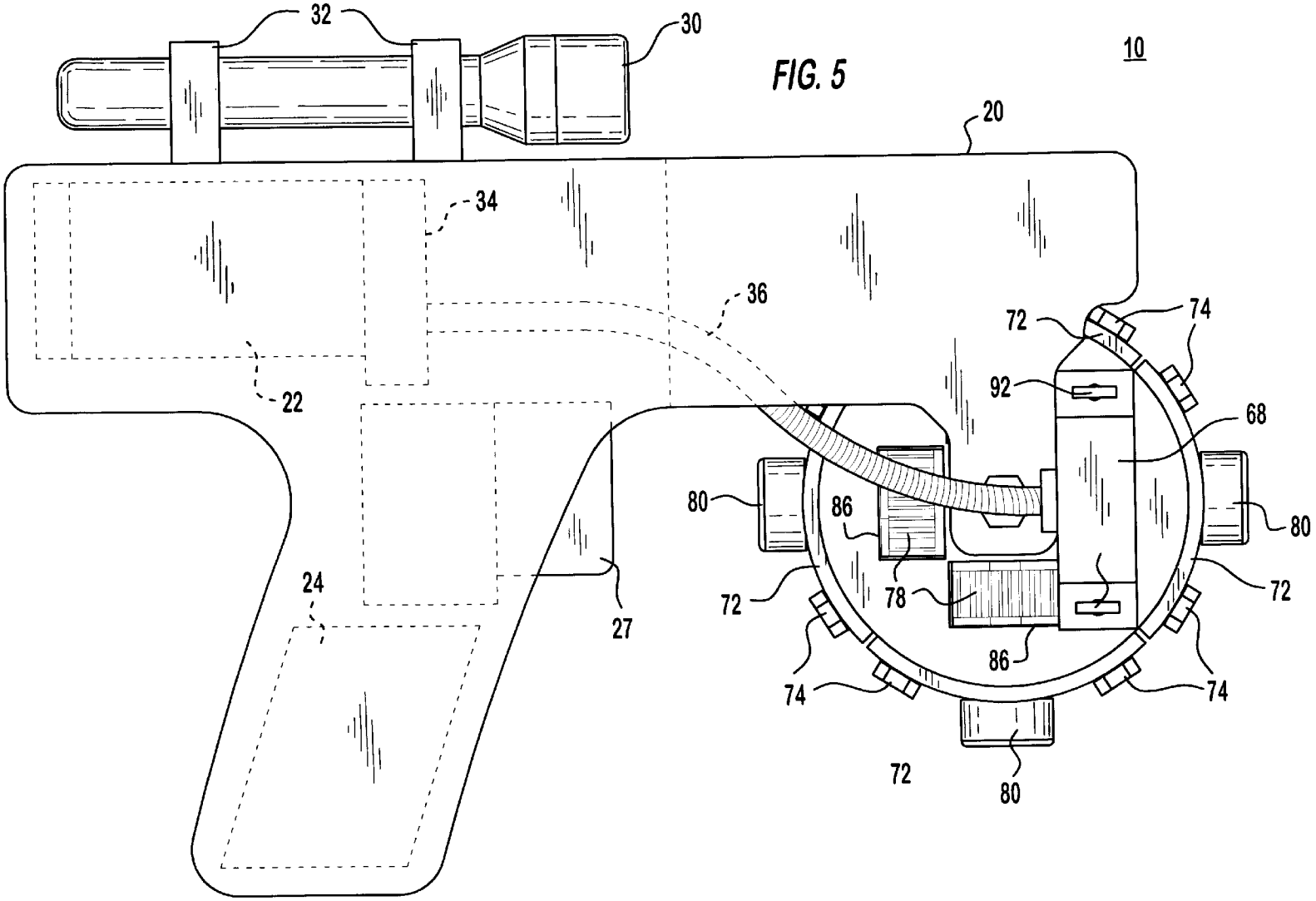
FIG. 5 is a plane view of the right side of the hand tool body showing the relative positions of components in and on one embodiment of the multiple rotary hand tool of the present invention.

The present invention, as shown in the drawings, is the multiple rotary socket hand tool 10. The hand tool 10 comprises a hand tool body 20 and a tool disk 60. The hand tool body 20 contains a motor 22, generally positioned as shown in FIG. 5, which serves as the powered drive for driving a socket 80. Typically, a dc motor with a high torque output would be selected for this application. Optionally, a torque-adjusting switch 28 can be provided as shown in FIG. 1, along with appropriate components known in the art to provide for a variable torque drive. A battery pack 24 is provided as a power source for the motor. A 12-volt dc battery pack properly configured to fit in the hand tool body 20, as shown in FIG. 5, could be used. In an alternate embodiment of the invention, the motor can be driven by an external ac power source connected to the hand tool body 20 by a power cord (not shown in the drawings). An ac to dc power converter circuit, as known in the art, can be provided in the hand tool body 20 to convert the external ac power to the dc power required for the motor 22. Motor direction reversing direction switch 26 can be provided as a two-pole switch to reverse the motor's output drive shaft direction, which will reverse the direction of the tool drive components and tool bit in use as further described below. Trigger switch 27 is used to start or stop motor 22, which will start or stop the tool drive components and tool bit in use. Trigger switch 27 can be of an infinite range design that will allow an infinite range in speed of the motor 22 and the tool bit in use. Alternatively, trigger switch 27 can be used to provide a low speed range and high-speed range for the tool bit in use, Typical speeds for the tool bit in use is 0 to 350 rpm for the low speed range, and 0 to 1,250 rpm for high-speed range. Electrical circuits, although not shown, but known in the art, can be used to vary the speed of motor 22 and perform other control functions for the hand tool 10. In one embodiment of the invention, a flashlight 30 may be removably attached to the hand tool 10 by one or more fasteners 32. With some motor designs, a reduction gear 34 may be required to reduce the speed of motor 22. The reduction gear may also include an adjustable clutch that can provide a range of torque values, typically from 15 to 200 inches per pound, or a fixed high torque value of approximately 300 inches per pound.

Generally, the term "tool drive" is used to describe the motor 22, reduction gear 34, with clutch, if used, and the associated drive controls identified above. The tool drive is enclosed in the tool body 20. The output of the tool drive, whether the output of the motor, or the reduction gear 34 with clutch, if used, is connected to the flexible transmission drive as described below.

Figure 4:
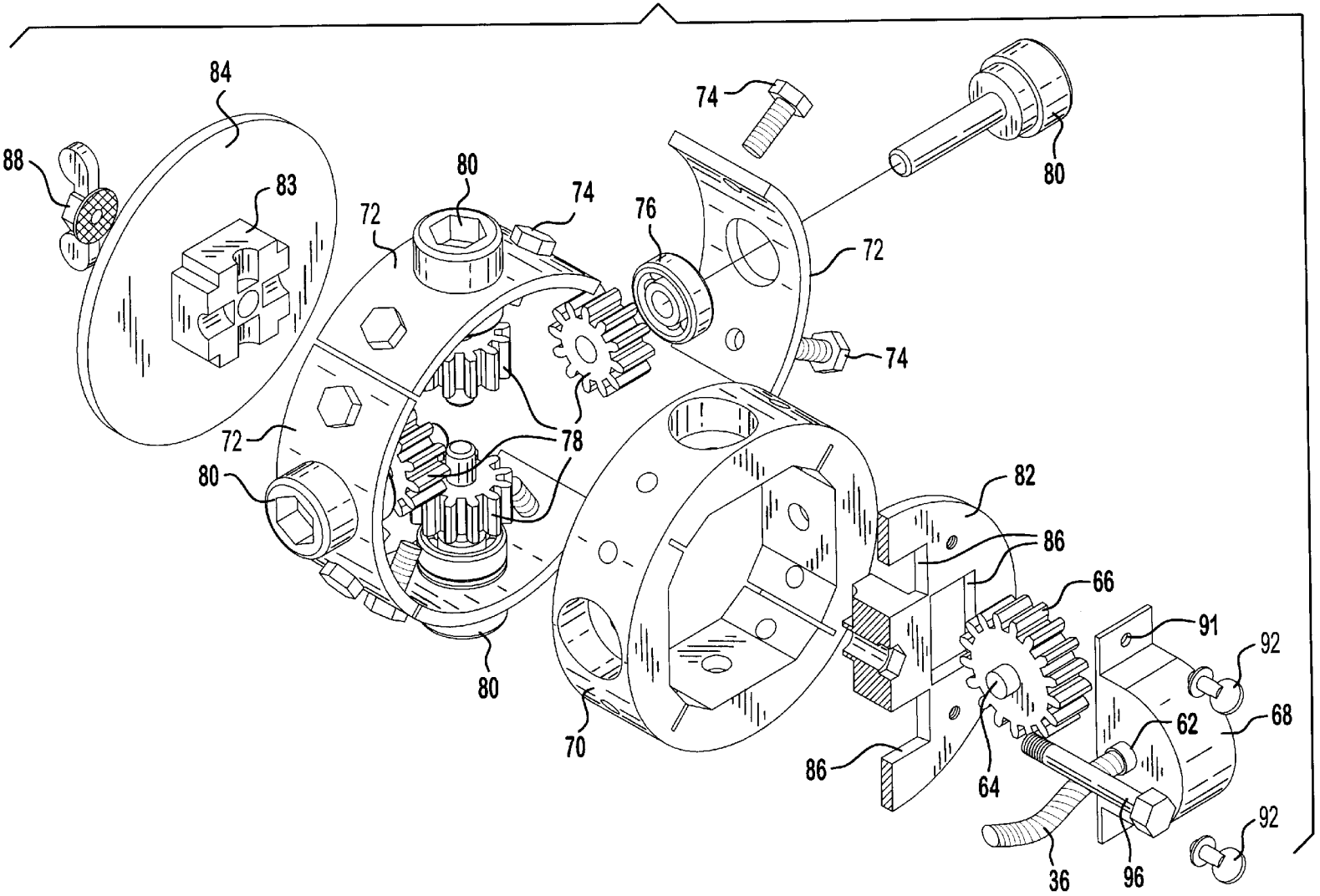
FIG. 4 is an exploded view of a tool disk used with the multiple rotary socket hand tool of the present invention.

A flexible drive shaft 36 is adapted at one end to cooperate with the shaft output of the motor 22, via the reduction gear 34, if used. A bevel gear and pinion assembly may be adapted for this connection. The other end of the flexible drive shaft 36 is connected to the drive gear ball bearing 62, which is adapted to cooperate with the drive gear shaft 64. Generally, the flexible drive shaft should have a length of less than 4 inches to avoid any whip action that may result when the hand tool is used at a high speed setting. A suitable flexible drive shaft is available from Superior Industrial International Inc, VAN NUYS, Calif., Part No. 47-0050-80. The drive gear shaft 64 is connected to drive gear 66. The drive gear 66 is partially contained in drive gear enclosure 68 as best shown in FIG. 4.

Generally, the term "flexible transmission drive" is used to describe the flexible drive shaft 36 and all necessary components required for the flexible drive shaft 36 to connect at one end to the output of the motor 22, or reduction gear 34, with clutch, if used, and to the tool bit gear 78 of the selected tool bit, or socket, as further described below.

The tool disk 60 includes a center inner body 70 that serves as the connecting means for components of the tool disk 60. Four sockets 80 are shown in the figures as being connected to tool disk 60. In alternate embodiments of the invention, more or less than four sockets may be connected to the tool disk 60. Furthermore, in alternate embodiments of the invention, the sockets can be replaced by other tool bits, such as, but not limited to, flat blade or Phillips bits to drive screws, setscrew (Allen or hex) bits, drill and other boring bits, or other special tool bits. A tool bit retaining plate 72, held in place by one or more fasteners 74 to inner body 70, holds tool bit ball bearing 76 and tool bit gear 78 within the inner body 70. Each socket 80 is connected to a tool bit gear 78 so that when drive gear 66 is in position to mesh with one of the four tool bit gears 78 shown in the drawings, that socket will be placed in use and driven by motor 22 through the drive components. Each socket 80 can be either permanently or replaceably attached to its tool bit gear 78. For example, a tool chuck, not shown in the drawings, can be attached to the tool bit gear 78 for replaceable attachment of socket 80, or another tool bit. An extension rod, not shown in the drawings, could be used in place of a socket 80 to extend the reach of a socket, or other tool bit, that is attached to the other end of the extension rod. First tool disk end plate 84 can include a positioning block 83 to keep the shafts of the tool bit gears 78 in proper alignment. Second tool disk end plate 82 can include a similar positioning block to mate with the positioning block 83. Second tool disk end plate 82 also includes openings 86, or windows, through which drive gear 66 can engage one of the selected four tool bit gears 78 shown in the drawings.

Tool disk rotating shaft 96 is positioned through openings in first and second tool disk end plates, 84 and 82, as shown in the drawings. A fastener 88, shown in one embodiment as a wingnut in FIG. 4, holds the tool disk rotating shaft 96 in place.

When one of the four tool bits 80 on the tool disk 60 is selected for use, the tool disk is rotated about its rotating shaft 96 so that the tool bit selected for use is facing towards the front of the hand tool 10. Drive gear enclosure 68 is fastened to second tool disk end plate 82 through an opening 86 so that the drive gear 66 engages the tool bit gear 78 of the socket selected for use. As shown in the figures, one method of fastening the drive gear enclosure 68 to the second tool disk end plate 82 is via thumb screws 92, which are placed through openings 91 in the enclosure and screwed into threaded holes provided on the second tool disk end plate 82. To change to another socket or tool bit on the tool disk 60, the drive gear enclosure 68 is unfastened from the second tool disk end plate 82 and the tool disk 60 is rotated to place the newly selected socket or tool piece in the use position. The drive gear enclosure 68 is then refastened to second tool disk end plate 82 through the opening associated with the newly selected socket or tool bit.

Figure 6:
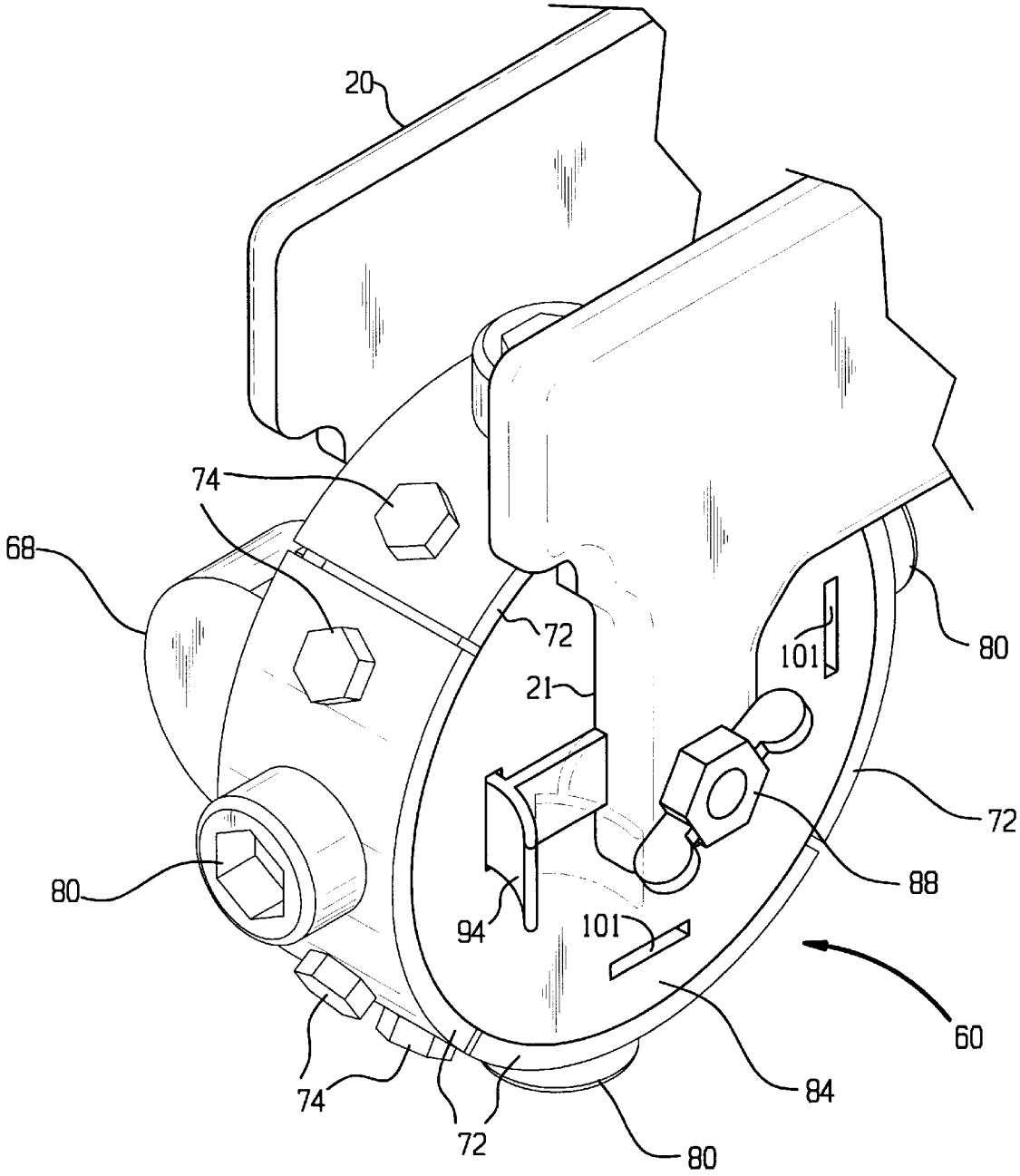
FIG. 6 is a partial perspective view of a tool disk showing a locking mechanism used with the present invention.

As shown in FIG. 6, a tool disk locking tab 94, can be provided to ensure that the disk tool 60 remains in a fixed position relative to the arm 21 of the hand tool body 20. Flexing tool disk locking tab 94 is attached to the arm 21 of the hand tool body 20. When the tool disk 60 is rotated about its rotating shaft 96, tab 94 is flexed out of locking slot 101 on the first tool disk end plate 84 by the user and then reinserted in the appropriate locking slot 96 for the selected socket or tool piece.

In using the preferred embodiment of my invention, one would select an appropriate tool disk 60, with the appropriate sockets, screwdriver bits, drilling bits, or other types of tool pieces, attach it to the hand tool body 20, align the desired tool on the tool disk 60 with the drive gear 66 and operate the hand tool to drive the tool.

I claim:

1. A hand tool with a plurality of selectable tool bits comprising:

a tool body;

a tool drive enclosed in said tool body, said tool drive having an output to provide power for driving the selectable tool bits;

a flexible drive shaft having first and second ends, said first end connected to the output of said tool drive; and a tool disk rotatably attached to the tool body, said tool disk having the plurality of selectable tool bits disposed radially around a perimeter of said tool disk and means to connect the second end of said flexible drive shaft to a selected tool bit, whereby the selected tool bit is driven by the tool drive.

2. The hand tool of claim 1 wherein power is provided for said tool drive by a battery in the tool body or an external power source.

3. The hand tool of claim 1 further comprising a flashlight removably attached to the tool body.

4. The powered hand tool of claim 1 wherein at least one of the tool bits is a flat head screwdriver blade or a Phillips head screwdriver.

5. The hand tool of claim 1 wherein said tool disk can be removed from said tool body.

6. A hand tool with a plurality of selectable tool bits comprising:

a tool body;

a tool drive enclosed in said tool body, said tool drive having an output to provide power for selectively driving said plurality of selectable tool bits;

a flexible drive shaft having a first end and a second end, said first end connected to said output of said tool drive; and a tool disk rotatably attached to said tool body and having said plurality of selectable tool bits disposed radially around a perimeter, of said tool disk further comprising:

a center inner body;

a bit drive ball bearing connected to each of said plurality of selectable tool bits;

a bit drive gear connected to each of said plurality of selectable tool bits;

a retaining plate for each of said plurality of selectable tool bits to retain said bit drive ball bearing and said bit drive gear within said center inner body;

a first tool disk end plate attached to a first side of said center inner body;

a second tool disk end plate attached to a second side of said center inner body, said second tool disk end plate having an opening for access to each of said bit drive gears; and a a tool disk rotating shaft disposed through a center of said first and second tool disk end plates and said center inner body whereby said tool disk can be rotated on said tool body to selectively attach said second end of said flexible drive shaft to one of said bit drive gears through means.

7. The hand tool of claim 6 wherein at least one of said plurality of selectable tool bits is removably attached to said bit drive ball bearing and bit drive gear.

8. The hand tool of claim 6 wherein input power to said tool drive is provided from a battery in said tool body.

9. The hand tool of claim 6 wherein input power to said tool drive is provided from an external power source.

10. The hand tool of claim 6 further comprising a flashlight removably attached to the tool body.

11. The hand tool of claim 6 wherein at least one of said plurality of selectable tool bits is a flat head screwdriver blade or a Phillips head screwdriver.

12. The hand tool of claim 6 wherein said tool disk can be removed from said tool body.

13. The hand tool of claim 6 wherein at least one of said plurality of selectable tool bits is replaced by an extension rod to extend the reach of a tool bit.

14. The hand tool of claim 6 wherein said tool disk is locked into position relative to said tool body.

15. A hand tool with a plurality of selectable tool bits comprising:

a tool body;

a tool drive enclosed in said tool body, said tool drive having an output shaft to provide power for selectively driving said plurality of selectable tool bits;

a flexible drive shaft having a first end and a second end, said first end connected to said output shaft of said tool drive; and said second end attached to a shaft drive gear;

a bit drive ball bearing connected to each of said plurality of selectable tool bits;

a bit drive gear connected to each of said plurality of selectable tool bits;

means for retaining said bit drive bearings and said bit drive gears within a tool disk rotatably attached to said tool body; and means for selectively connecting said shaft drive gear to a selected bit drive gear whereby power is transferred from said tool drive to said selected bit drive gear.

* * * * *